US008070461B2

(12) United States Patent
Sanford

(10) Patent No.: US 8,070,461 B2
(45) Date of Patent: Dec. 6, 2011

(54) CONTROL VALVE ASSEMBLY FOR A COMPRESSOR UNLOADER

(75) Inventor: Joel T. Sanford, Bath, NY (US)

(73) Assignee: Dresser-Rand Company, Olean, NY (US)

( * ) Notice: Subject to any disclaimer, the term of this patent is extended or adjusted under 35 U.S.C. 154(b) by 706 days.

(21) Appl. No.: 12/299,061

(22) PCT Filed: Apr. 2, 2007

(86) PCT No.: PCT/US2007/008149

§ 371 (c)(1),
(2), (4) Date: Oct. 30, 2008

(87) PCT Pub. No.: WO2007/120506

PCT Pub. Date: Oct. 25, 2007

(65) Prior Publication Data

US 2009/0238699 A1 Sep. 24, 2009

Related U.S. Application Data

(60) Provisional application No. 60/787,952, filed on Mar. 31, 2006.

(51) Int. Cl.
*F04B 49/00* (2006.01)

(52) U.S. Cl. ..... 417/306; 137/115.13

(58) Field of Classification Search ..... 417/111, 417/275, 306–309, 440; 113/115.13, 116.3
See application file for complete search history.

(56) References Cited

U.S. PATENT DOCUMENTS 7,270,145 B2 9/2007 Koezler
2002/0141884 A1* 10/2002 Sperry ..... 417/306
2004/0007261 A1 1/2004 Cornwell

FOREIGN PATENT DOCUMENTS

GB 2323639 A 9/1998

OTHER PUBLICATIONS

International Search Report and Written Opinion of the International Searching Authority for Patent Cooperation Treaty Application No. PCT/US2007/08149, dated Jul. 17, 2008, pp. 1-7.

* cited by examiner

*Primary Examiner* — Toan Ton
*Assistant Examiner* — Andrew Coughlin
(74) *Attorney, Agent, or Firm* — Edmonds & Nolte, PC

(57) ABSTRACT

A closing element is for a valve assembly of a compressor unloader, the compressor including a casing with a compression chamber, the unloader including a housing defining a chamber. The valve assembly has a base between the compression and unloader chambers, a passage connecting the two chambers, a seat about the passage, and a stem bore within the base having a control chamber. The closing element includes a main body movably disposed within the stem bore and having a sealing surface disposeable against the valve seating surface to obstruct the valve passage and a control end surface within the bore control chamber A sealing member disposed about the main body prevents flow between the control chamber and the valve passage. The main body and/or the sealing member is configured such that the main body is radially moveable to align the body sealing surface with the valve seat.

34 Claims, 13 Drawing Sheets

CONTROL VALVE ASSEMBLY FOR A COMPRESSOR UNLOADER

The present invention relates to fluid machinery, and more specifically to unloader assemblies for compressors.

Compressors for pressurizing or compressing fluids are known and are typically of either the rotary or reciprocating types. A reciprocating compressor basically includes a body or cylinder defining a compression chamber and a piston movably disposed within the cylinder chamber. With this structure, linear reciprocating displacement of the piston within the chamber compresses gas (commonly referred to as "process" fluid or gas) located within the chamber, which is subsequently discharged at the increased pressure.

To better control the maximum pressure in the compressor and/or the output rate of the compressed process gas, reciprocating compressors are often provided with an unloader assembly or unloader that provides a fixed volume chamber removably connectable with compression chamber. A valve assembly controls the flow between the compression and unloader chambers and determines when process fluid is able to move between the two chambers and alternatively when the chambers are sealed or isolated from each other.

SUMMARY OF THE INVENTION

In one aspect, the present invention is a closing element for a valve assembly of a compressor unloader, the compressor including a casing and a compression chamber defined within the casing and the unloader includes a housing defining a fixed volume chamber. The valve assembly has a base disposed generally between the compression and unloader chambers, a passage extending through the base and fluidly connecting the two chambers, a seat defined about a section of the passage, and a stem bore defined within the base and having a control chamber section and a central axis. The valve closing element comprises a generally cylindrical main body movably disposed at least partially within the stem bore so as to be displaceable generally along the bore axis. The main body has a sealing end surface, the sealing surface being disposeable against the valve seating surface so as to substantially obstruct the valve passage, and an opposing control end surface disposed within the bore control chamber section. A sealing member is disposed generally about the main body and is located generally between the sealing and control surfaces, the sealing member being configured to substantially prevent fluid flow between the control chamber section and the valve passage through the stem bore. At least one of the cylindrical main body and the sealing member is configured such that the main body is generally radially moveable with respect to the bore axis to at least generally align the main body sealing surface with the valve seat.

In another aspect, the present invention is a valve assembly for a compressor unloader, the compressor including a casing and a compression chamber defined within the casing and the unloader including a housing defining a fixed volume chamber. The valve assembly comprises a base disposed generally between the compression and unloader chambers, the base having a plurality of passages extending through the base and fluidly connecting the compression and unloader chambers, a plurality of valve seats each defined about a section of a separate one the passages, and plurality of stem bores each defined within the base proximal to a separate one of the passages and each having a control chamber section and a central axis. A plurality of valve closing elements are disposed within each stem bore, each closing element including a generally cylindrical main body movably disposed at least partially within the stem bore so as to be displaceable generally along the bore axis. The main body has a sealing end surface disposeable against the valve seating surface so as to substantially obstruct the valve passage, and an opposing control end surface disposed within the bore control chamber section. Further, a sealing member is disposed generally about each closing element main body and is located generally between the sealing and control surfaces. Each sealing member is configured to substantially prevent fluid flow between the control chamber section and the valve passage through the stem bore. Furthermore, the cylindrical main body and/or the sealing member is configured such that the main body is generally radially moveable with respect to the bore axis to at least generally align the main body sealing surface with the valve seat.

In a further aspect, the present invention is a compressor assembly comprising a compressor including a casing, a compression chamber defined within the casing, and a compression member movably disposed within the chamber. An unloader is mounted to the casing and includes a housing defining a fixed volume chamber fluidly connectable with the compression chamber. A valve assembly is configured to control flow between the compression chamber and the unloader chamber and includes a base disposed generally between the compression and unloader chambers. The base includes a passage extending through the base and fluidly connecting the two chambers, a seat defined about a section of the passage, and a stem bore defined within the base and having a control chamber section and a central axis. Further, a valve closing element includes a generally cylindrical main body movably disposed at least partially within the stem bore so as to be displaceable generally along the bore axis and a sealing member disposed generally about the main body. The main body has a sealing end surface disposeable against the valve seating surface so as to substantially obstruct the valve passage and an opposing control end surface disposed within the bore control chamber section. Furthermore, the sealing member is configured to substantially prevent fluid flow between the control chamber section and the fluid passage. At least one of the cylindrical main body and the sealing member is configured such that the main body is generally radially moveable with respect to the bore axis to at least generally align the main body sealing surface with the valve seat.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
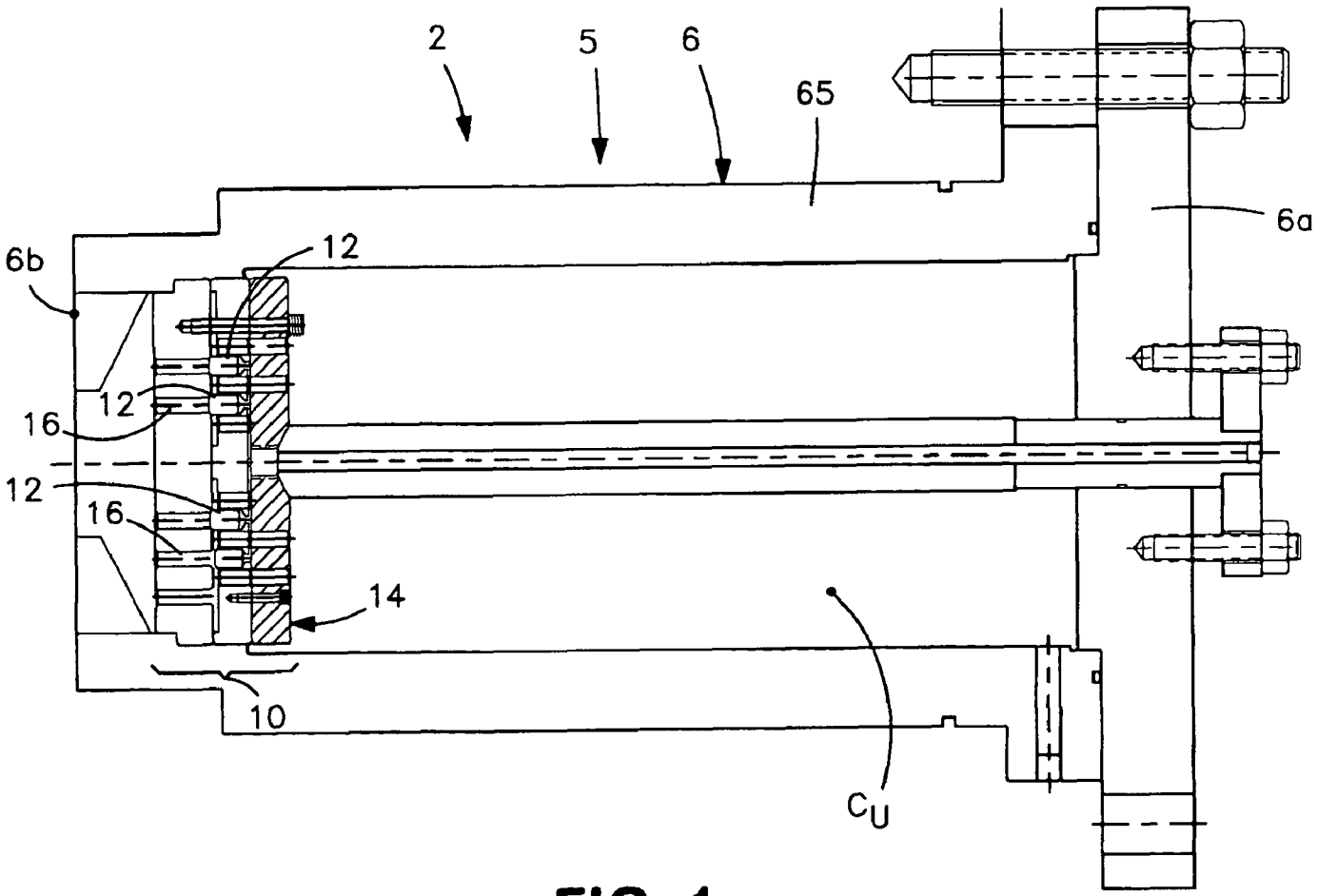
FIG. 1 is an axial cross-sectional view through a valve assembly and a plurality of closing elements in accordance with the present invention, shown connected with a compressor unloader.

Certain terminology is used in the following description for convenience only and is not limiting. The words "upper", "upward", "down" and "downward" designate directions in the drawings to which reference is made. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import.

Figure 10:
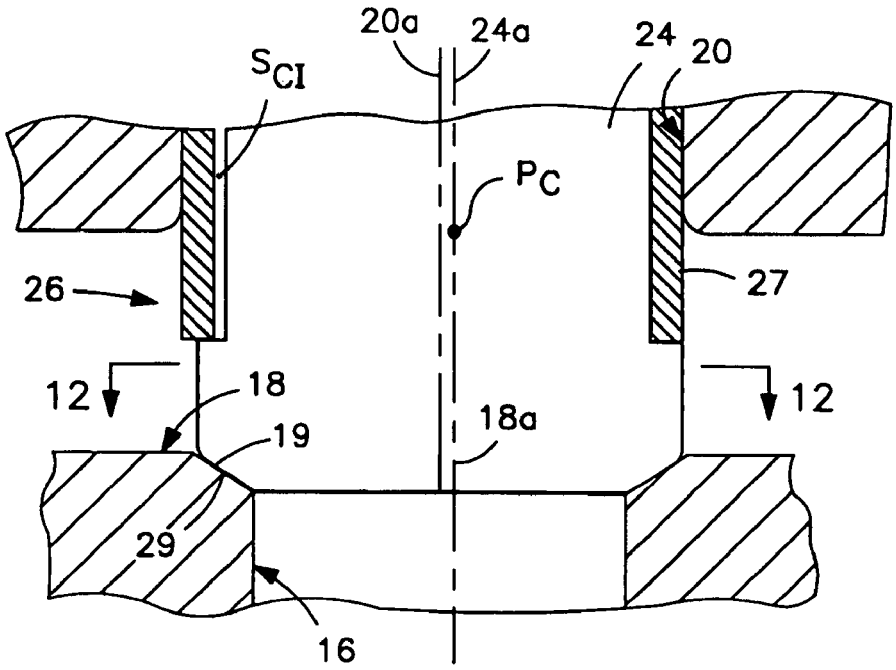
FIG. 10 is another view of the closing element and valve seat of FIG. 10, showing the closing element at the valve closed position and aligned with the seat.
Figure 11:
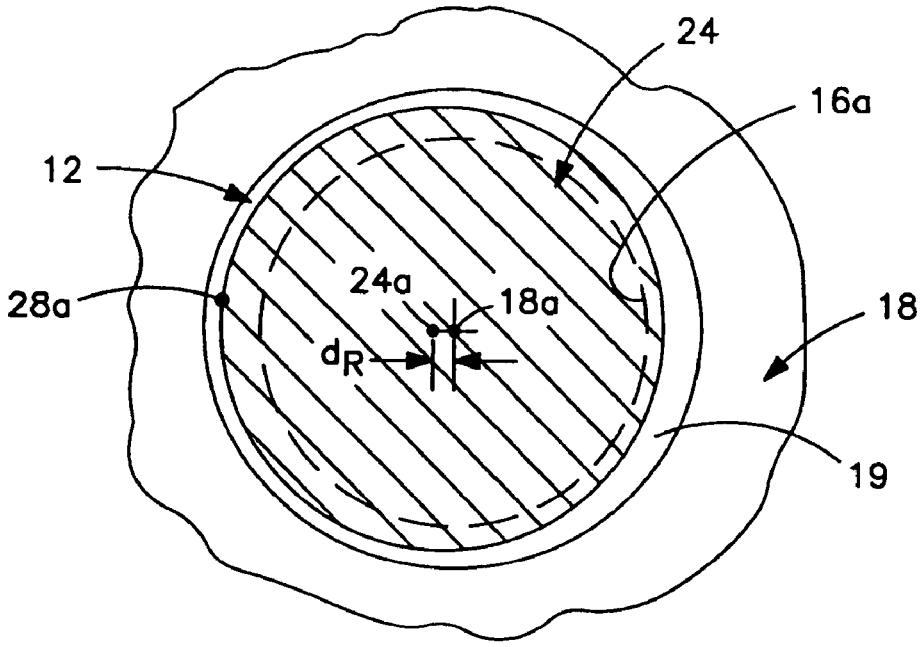
FIG. 11 is a view through line 11-11 of FIG. 9.

Referring now to the drawings in detail, wherein like numbers are used to indicate like elements throughout, there is shown in FIGS. 1-18 a valve assembly 10 for an unloader 2 of a compressor 1, the valve assembly 10 including one or more improved closing elements 12 in accordance with the present invention. As best shown in FIG. 10, the compressor 1 basically includes a cylinder or casing 3, a compression chamber $C_C$ defined within the casing 3, and a compression member or piston 4 movably disposed within the chamber $C_C$, and the unloader 2 includes a housing 5 defining a fixed volume chamber $C_U$. The valve assembly 10 comprises a base 14 disposed generally between the compression and unloader chambers $C_C$, $C_U$, at least one and preferably a plurality of passages 16 extending through the base 14 and fluidly connecting the two chambers $C_C$, $C_U$, and at least one and preferably a plurality of valve seats 18 each defined about a section of a separate one of the passages 16. At least one and preferably a plurality of stem bores 20 are each defined within the base 14 so as located at least generally proximal to a separate valve seat 18. Each stem bore 20 has a control chamber section 22, a central axis 20*a*, and an inner circumferential surface 21 extending about the axis 20*a*. Further, the one or more valve closing elements 12 each basically comprises a generally cylindrical main body 24 movably disposed at least partially within a separate one of the stem bores 20, so as to be displaceable generally along the bore axis 20*a*, and at least one sealing member 26 coupled with and disposed generally about the main body 24. Each cylindrical main body 24 has a sealing end surface 28 disposeable against the proximal valve seat 18 so as to substantially obstruct the valve passage 16, thereby preventing fluid flow therethrough, and an opposing control end surface 30 disposed within the stem bore control chamber section 22.

More specifically, the closing element main body 24 is displaceable with respect to the associated stem bore 20 (i.e., along the bore axis 20*a*) between a closed position $p_C$ (FIGS. 4 and 10), at which the main body sealing surface 28 is disposed generally against the proximal valve seat 18, and at least one and preferably a plurality of open positions $p_O$ (FIG. 5) spaced axially from the closed position $p_C$, at which the main body sealing surface 28 is spaced from the associated valve seat 18. That is, the one or more valve open positions $p_O$ are each any position of the main body 24 along the axis 20*a* at which the sealing end surface 28 is spaced from the associated valve seat 18. When all of the one or more closing elements 12 are each disposed at its closed position $p_C$, the unloader chamber $C_U$ is fluidly separated or sealed from the compression chamber $C_C$, and when the element(s) 12 are alternatively located at an open position $p_O$, the valve passage(s) 16 fluidly connect the compression chamber $C_C$ with the unloader chamber $C_U$. As such, the volume available to the fluid or process gas being compressed is increased, which reduces the gas pressure and/or the output rate of the compressor 1, as discussed below. Further, each closing element main body 24 (and thus also the coupled sealing member 26) is biased and/or displaced generally toward the closed position $p_C$ (FIGS. 4 and 10) when pressure $P_C$ on the control end surface 30 is greater than pressure $P_S$ on the sealing end surface 28, and is alternatively biased/displaced toward at least one open position $p_O$ (FIG. 5) when pressure $P_S$ on the sealing end surface 28 is greater than pressure $P_C$ on the control end surface 30, as discussed in further detail below.

Figure 16:
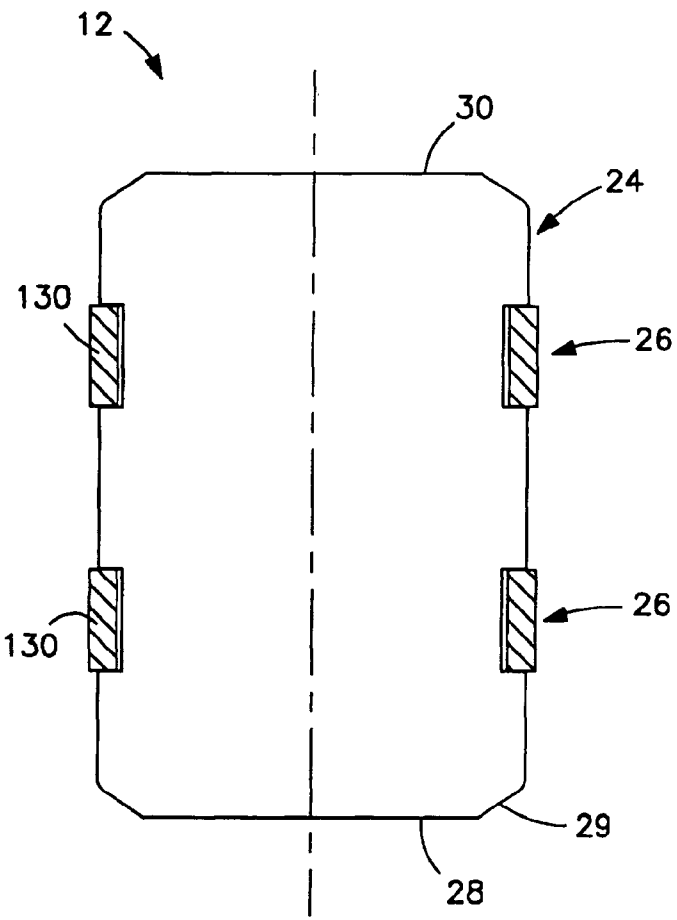
FIG. 16 is an axial cross-sectional view of an alternative valve closing element having two sealing members.
Figure 18:
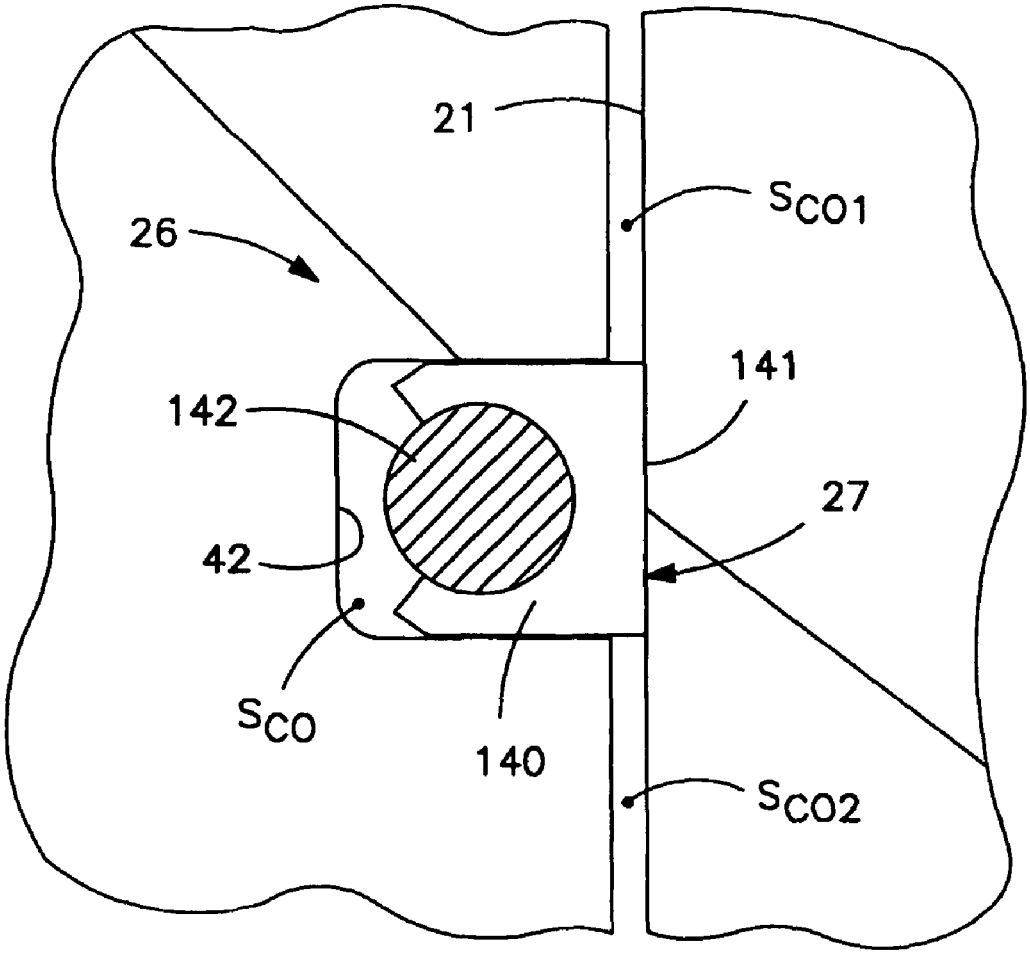
FIG. 18 is a greatly enlarged, cross-sectional view of a portion of the closing element of FIG. 17.

Further, the one or more sealing member(s) 26 of each closing element 12 is configured to substantially prevent fluid flow between the control chamber section 22 and the valve fluid passage 16 through the associated stem bore 20, i.e., through any space between the main body 24 and the stem bore 20. Specifically, each sealing member 26 has an outer circumferential sealing surface 27 disposeable against or engageable with the stem bore 20 so as to prevent fluid flow between the stem bore chamber section 22 and the associated valve passage 16. Furthermore, the sealing member(s) 26 are each configured such that at least a portion of the outer circumferential sealing surface 27 remains disposed against/engaged with the stem bore 20 as the main body 24 displaces between the closed and open positions $p_C$, $p_O$. Preferably, each closing element 12 includes a single sealing member 26 (e.g., formed as a tube, sleeve, ring, etc.) having an axial length $L_S$ (FIG. 7) sufficiently greater than the total axial displacement $d_A$ (FIG. 5) of the main body member 24, thus enabling at least a portion of the sealing surface 27 to always remains in contact with and/or engaged with the stem bore 20. However, each closing element 12 may alternatively include two or more members 26 (e.g., generally annular rings) spaced axially upon the main body 24 and arranged such that at least one member 26 is always engaged with the stem bore 20, as shown in FIG. 16 and discussed in greater detail below.

Figure 7:
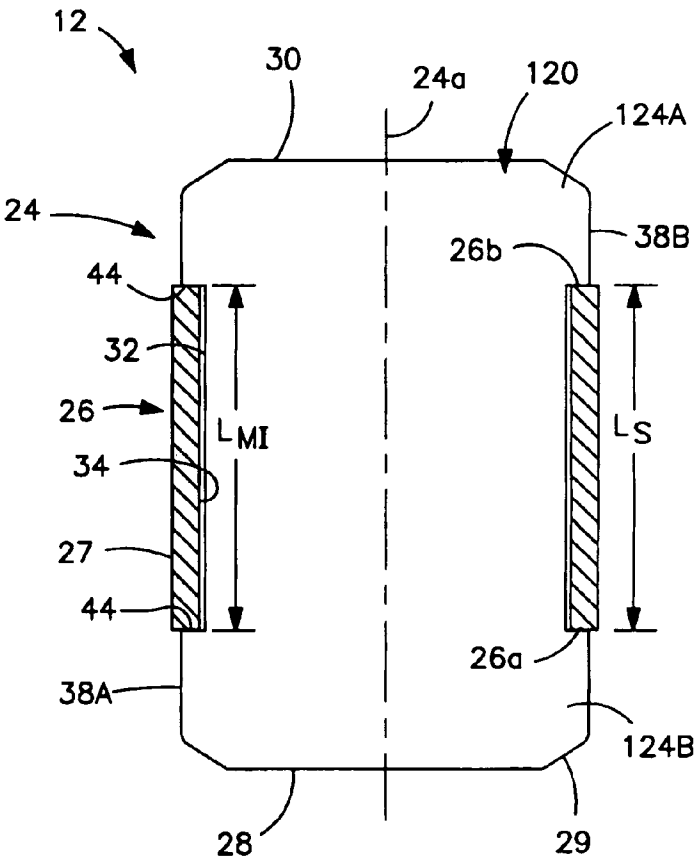
FIG. 7 is a greatly enlarged axial cross-sectional view of the closing element.
Figure 8:
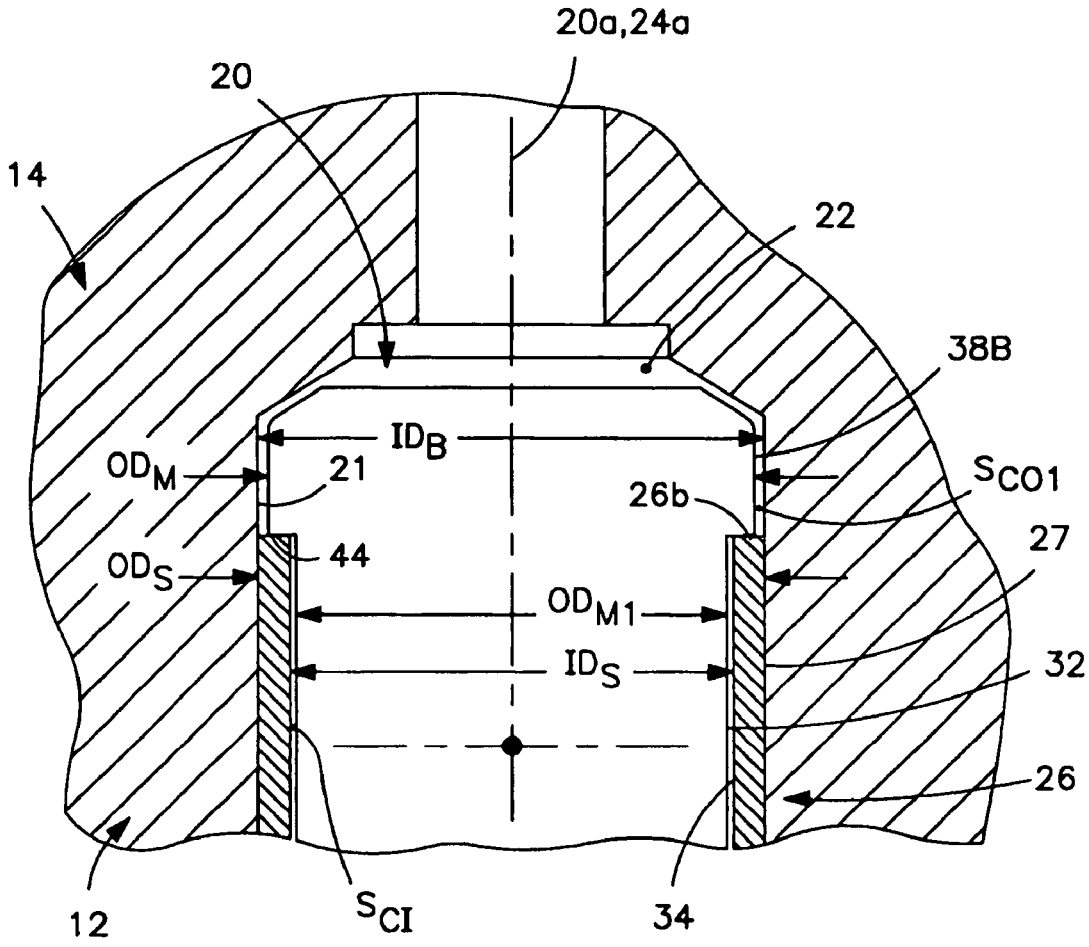
FIG. 8 is a broken-away, greatly enlarged view of a closing element within a stem bore.
Figure 9:
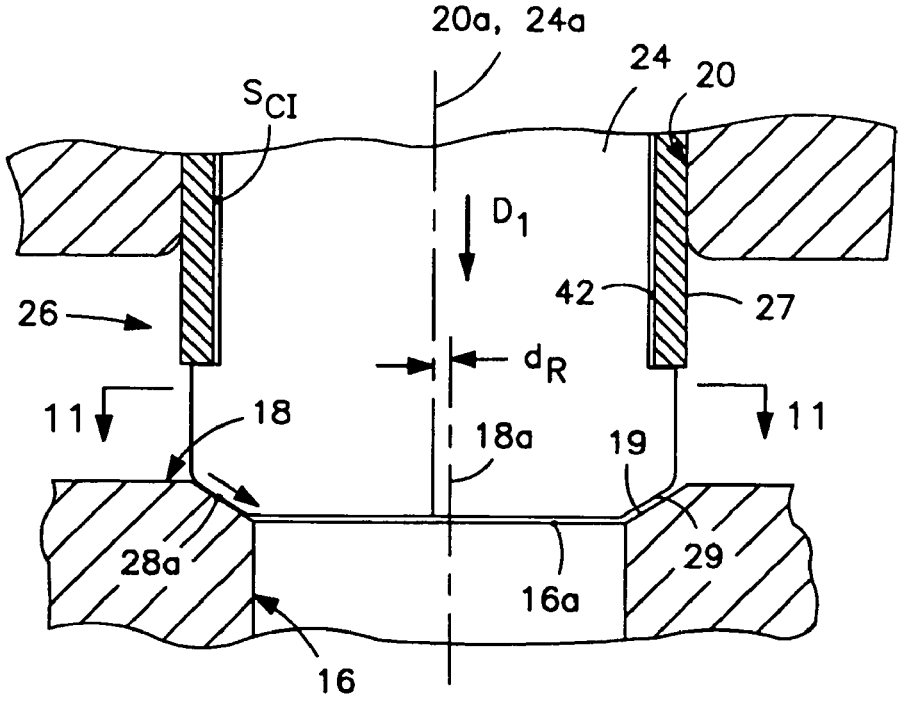
FIG. 9 is a more enlarged, broken-away axial cross-sectional view of a closing element during initial contact with a valve seat, showing the closing element misaligned with the seat.

Referring particularly to FIGS. 7 and 8, the sealing member 26 and/or the cylindrical main body 24 of each closing element 12 are/is further configured to enable radial movement or displacement of the main body 24 with respect the bore axis 20*a*, such that the main body sealing surface 28 is at least generally alignable with the valve seat 18. In other words, the structure of the sealing member 26 and/or the main body 24, and the manner by which the two components 24, 26 are connected together, permits the main body 24 to move or shift radially or transversely, during axial displacement of the body 24 toward the valve seat 18, as necessary to enable the closing element main body 24 to properly mate with the valve seat 18. Preferably, each valve seat 18 is generally centered about an axis 18*a* and the sealing surface 28 of each main body 24 is generally centered about an axis 24*a* through the main body 24, as discussed below. Further, the main body 24 and/or the sealing member 26 of each element 12 is configured to enable sufficient radial displacement $d_R$ of the main body 24 with respect to the bore axis 20*a* such that when the sealing surface axis 24*a* is spaced radially apart from the valve seat axis 18*a* (see FIG. 9), the sealing surface axis 24*a* becomes generally coaxially aligned with the valve seat axis 18*a* when the body sealing surface 28 contacts the valve seat 18, as shown in FIG. 10.

Figure 12:
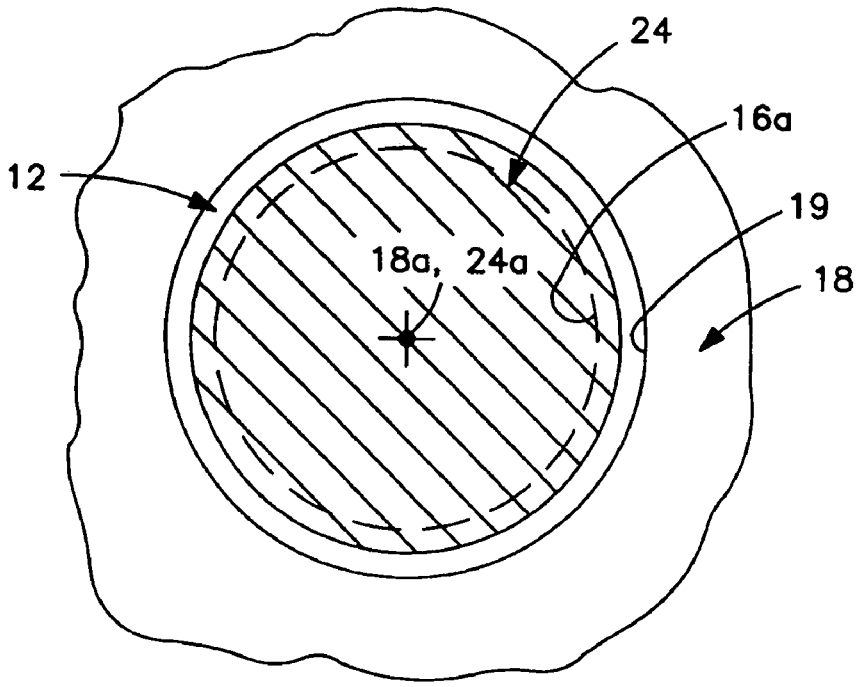
FIG. 12 is a view through line 12-12 of FIG. 10.

More specifically, the cylindrical main body 24 (and thus also the sealing member 26) of each closing element 12 is displaceable in first and second, opposing directions $D_1$, $D_2$ along the stem bore axis 20*a* generally toward the associated valve seat 18. The main body 24 and/or the sealing member 26 are/is configured such that when the sealing surface 28 is misaligned with the valve seat 18 (i.e., axes 24*a*, 18*a* being spaced radially apart), contact between a radially-outermost portion 28*a* (FIGS. 9 and 11) of the sealing surface 28 and the valve seat 18 while the main body 24 displaces in the first direction $D_1$ pushes or forces the main body 24 to also displace radially until the sealing surface 28 is generally centered against the valve seat 18 (i.e., axes 18*a*, 24*a* aligned), as shown in FIGS. 10 and 12. Preferably, the capability of radially moving/displacing the closing element main body 24 with respect to the bore axis 20*a* is provided by forming or sizing both the main body 24 and the sealing member 26 so as to form generally annular clearance spaces $S_{CI}$, $S_{CO1}$), $S_{CO2}$ between the sealing member 26, the main body 24, and stem bore 20, as described in detail below.

Figure 6:
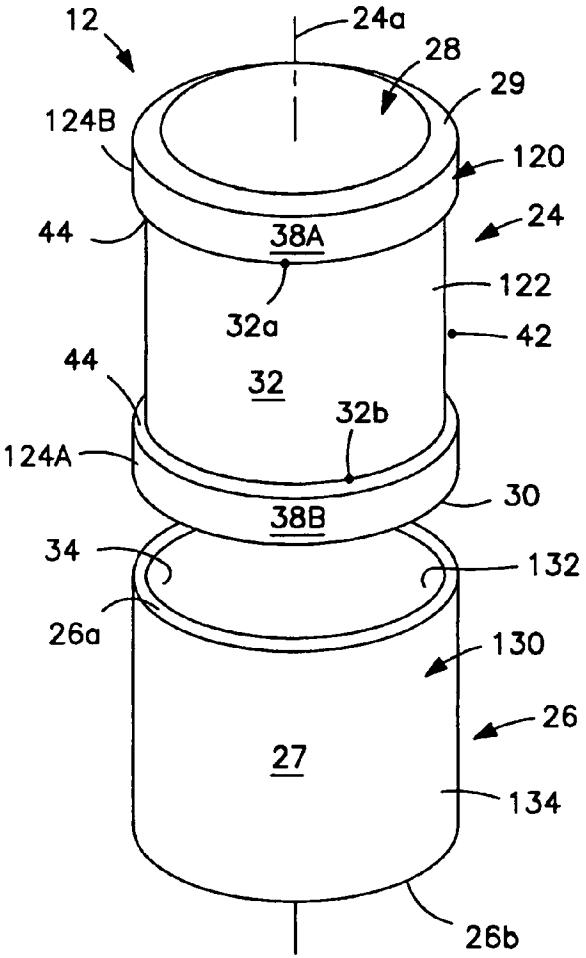
FIG. 6 is a greatly enlarged, exploded view of the closing element.

Referring to FIGS. 6-8, the closing element main body 24 has a longitudinal axis 24*a* and an outer circumferential surface 32 extending about the axis 24*a*, the surface 32 having an outside diameter $OD_{M1}$. The sealing member 26 has an inner circumferential surface 34 with an inside diameter $ID_S$, and the opposing outer circumferential sealing surface 27 (discussed above) has an outside diameter $OD_S$. The sealing member inner surface 34 is disposed generally coaxially about the main body outer surface 32 and, as discussed above, the sealing outer surface 27 is disposeable against the stem bore inner circumferential surface 21 to substantially prevent gas flow between the main body sealing and control ends 28, 30. Further, the inside diameter IDs of the sealing member inner surface 34 is sufficiently larger or greater than the outside diameter $OD_M$ of the main body outer surface 32 such that a generally annular, inner clearance space $S_{CI}$ is defined between the sealing member 26 and the closing element main body 24. As such, the inner clearance space $S_{CI}$ enables the main body 24 to be moveable radially with respect to (i.e., and within) the sealing member 26.

Figure 5:
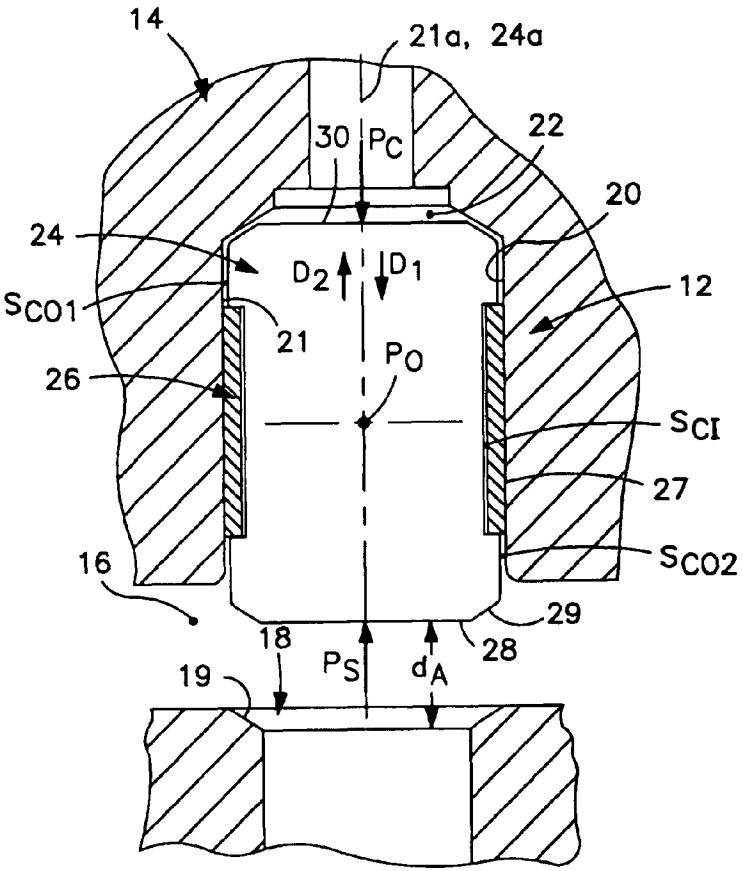
FIG. 5 is another view of the closing element of FIG. 4, shown in an open position.
Figure 4:
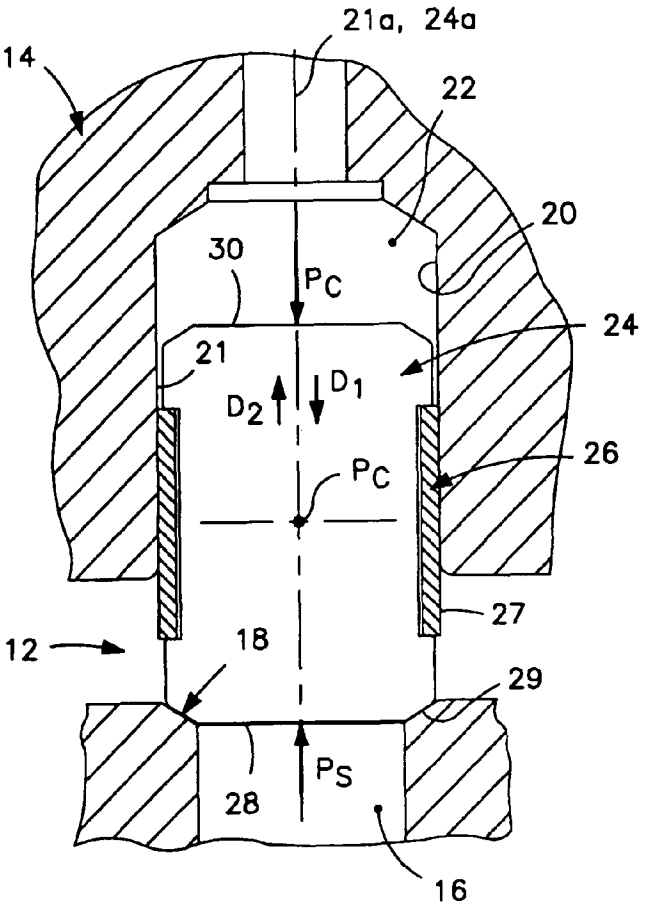
FIG. 4 is a broken-away, enlarged view of a single closing element of the present invention, shown in a closed position.

Furthermore, the main body 24 preferably has at least one and most preferably two second, radially-larger outer circumferential surfaces 38A, 38B each having an outside diameter $OD_{M2}$ greater than the diameter $OD_{M1}$ "first" or radially-smaller outer surface 32, and preferably larger than the sealing member inner surface inside diameter $ID_S$, for reasons described below. The outside diameter $OD_S$ of the sealing member outer surface 27 (i.e., which is engaged with the bore surface 21) is sufficiently larger/greater than the outside diameter $OD_{M2}$ of each main body second outer surface 38A, 38B such that "outer" clearance spaces $S_{CO1}$, $S_{CO2}$ are each defined between the bore inner surface 21 and each main body second outer surfaces 38A, 38B, as best shown in FIGS. 5 and 8. As such, these outer clearance spaces $S_{CO1}$, $S_{CO2}$ enable the main body 24 to be moveable radially with respect to (and within) the stem bore 20.

As described in detail above, the capability of radially moving/displacing the closing element main body 24 with respect to the bore axis 20*a* is preferably provided by forming or sizing both the main body 24 and the sealing member 26 so as to define the generally annular clearance spaces $S_{CI}$, $S_{CO1}$, $S_{CO2}$ between the sealing member 26, the main body 24, and stem bore 20. However, the main body 24 and/or the sealing member 24 may be configured or constructed in any other appropriate manner that enables or permits radial movement of the main body 24 within the bore 20. For example, the sealing member 26 may be coupled to the main body 24 without any substantial clearance and be formed so as to be radially deflectable or compressible, or formed/provided with a radially deflectable/moveable portion. As such, the main body 24 is radially displaceable with respect to the bore axis 20*a* by deflection, compression, or displacement of the sealing member 26. The scope of the present invention encompasses these and all other structures of the main body 24 and sealing member 26 that enable radial movement and other functioning of the valve closing element 12 as generally described herein.

Referring to FIGS. 4, 5 and 9-12, the benefit(s) of the above-described "radial mobility" is particularly evident with the preferred structure of the mating valve seat 18 and main body sealing surface 28 of the closure element 12. Specifically, the valve seat 18 preferably includes a beveled or generally frustaconical inner surface 19 (FIG. 5) extending circumferentially about a section of the valve passage 16 and the main body sealing surface 28 has a mating beveled or generally frustaconical outer surface section 29. The main body frustaconical surface section 29 is sized to fit against the valve seat frustaconical surface 19 so as to substantially obstruct or seal the valve passage 16. In other words, contact between the mating surfaces 29, 19 substantially seals an opening or inlet port 16*a* of the valve passage 16, which is surrounded by the valve seat surface 19, so as to at least substantially prevent fluid flow through the port 16*a*. Thus, the capability of radially moving the main body 24 with respect to both the sealing member 26 and the stem bore 20 enables the main body outer frustaconical surface section 29 to align with the valve seat inner frustoconical surface 19 as the closing element body 24 displaces generally toward the valve seat 18, as best shown in FIGS. 9-12, while the sealing member 26 still prevents fluid flow between the control chamber section 22 and valve passage 16 through the stem bore 20.

Further, the two radially-larger outer surfaces 38A, 38B are spaced axially apart and are each located generally proximal to a separate body end surface 28, 30, respectively, and the radially smaller outer surface 32 is disposed generally axially between the two larger outer surfaces 38A, 38B. As such, a generally annular recess 42 is defined generally between the radially larger outer surfaces 38A, 38B, which is configured to receive a portion of the sealing member 26 so as to couple the sealing member 26 to the main body 24. More specifically, the sealing member 26 has opposing axial ends 26*a*, 26*b* and an axial length $L_S$ that is preferably slightly lesser (or even substantially equal or slightly greater) than the axial length $L_{M1}$ of the main body radially-smaller outer surface 32 (see FIG. 7). Further, the main body 24 also has generally facing radial shoulders 44 extending generally radially between each axial end 32*a*, 32*b* of the radially smaller outer surface and the proximal radially-larger outer surface 38A, 38B. As such, the sealing member 26 is sized to be partially disposed within the main body recess 42 and is axially retained therein by the radial shoulders 44, thereby coupling or connecting the sealing member 26 with the main body 24 so as to seal the inner clearance space $S_{CI}$ from the outer clearance spaces $S_{CO1}$, $S_{CO2}$.

Referring now to FIGS. 3-5 and 14, the valve assembly 10 is constructed such that the main body 24 of each closing element 12 is displaceable within the associated stem bore 20 when pressure $P_S$, $P_C$ on one of the two main body end surfaces 28, 30, respectively, is sufficiently greater than pressure $P_C$, $P_S$ on the other one of the two main body end surfaces 30, 28. That is, the cylindrical main body 24 displaces in the first direction $D_1$ along the stem axis 20*a* and toward the valve seat 18 when the main body 24 is spaced from the valve seat 18 and pressure $P_C$ on the control end surface 30 is sufficiently greater than pressure $P_S$ on the sealing end surface 28. Alternatively, the cylindrical main body 24 displaces in a second direction $D_2$ along the stem axis 20*a* and generally away from the valve seat 18 when the main body 24 is at least generally proximal to the valve seat 18 and pressure $P_S$ on the sealing end surface 28 is sufficiently greater than pressure $P_C$ on the control end surface 30.

More specifically, the compressor 1 preferably further has an inlet 7 and an outlet 8 (see FIG. 10) each fluidly coupled with the compression chamber $C_C$, and the valve assembly 10 further includes a control fluid line 50 fluidly connected with the control chamber section 22 of each stem bore 20 and with the compressor inlet 7 or/and the compressor outlet 8. As such, the closing element main body 24 is displaced generally toward and/or disposed against the valve seat 18 when pressure $P_I$, $P_O$ at the inlet 7 or/and at the outlet 8 is greater than pressure $P_C$ in the compression chamber $C_C$. Alternatively, the main body member 24 is displaced generally away from or/and held spaced from the valve seat 18 when pressure $P_I$, $P_O$ at the inlet 7 or/and at the outlet 8 is lesser than pressure $P_C$ in the compression chamber $C_C$. Further, the pressure $P_S$ on the main body sealing end surface 28 is generally equal to pressure $P_C$ in the compression chamber $C_C$ and pressure on the main body control surface 30 is either generally equal to the pressure $P_I$ or $P_O$ at a connected one of the inlet 7 or outlet 8, a portion of one such pressure $P_I$, $P_O$, or a combination of the inlet and outlet pressures $P_I$, $P_O$ or portions thereof.

Figure 3:
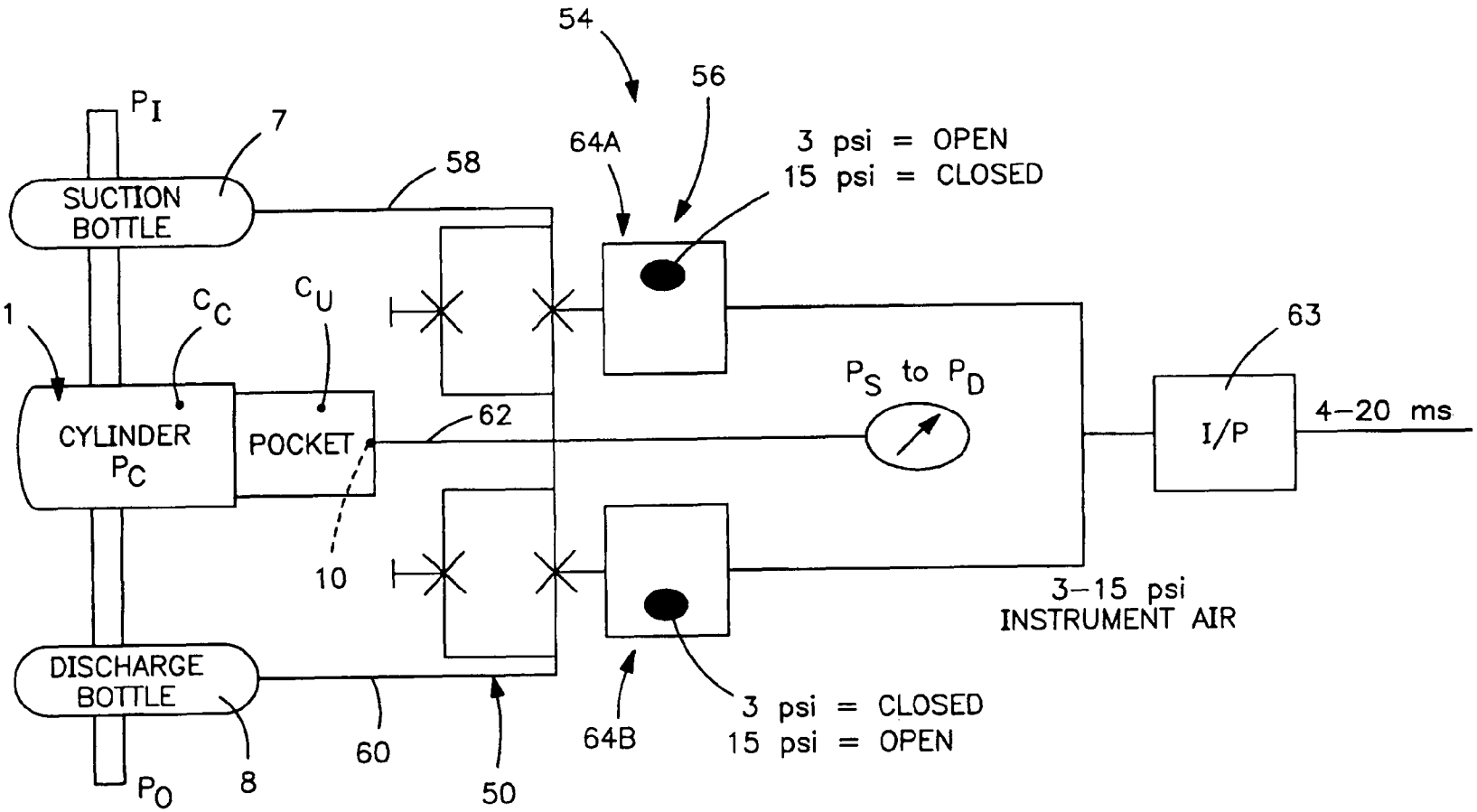
FIG. 3 is a more diagrammatic view of an unloader incorporating the valve assembly, shown with a compressor.

Referring particularly to FIG. 3, the valve assembly 10 preferably further has a control fluid assembly 54 including the control line 50 and a pressure regulator 56, and the control fluid line 50 preferably includes three separate fluid line sections 58, 60, 62 coupled with the regulator 56. Specifically, an inlet line section 58 is fluidly connected with the compressor inlet 7 and the regulator 56 and an outlet line section 60 is fluidly connected with the compressor outlet 8 and the regulator 56. A control output line section 62 extends between at least one and preferably all of stem bore control chambers 22 and the pressure regulator 56. Further, the regulator 56 is configured to adjust pressure in the output line section 64 between pressure $P_I$ at the compressor inlet 7 and at the compressor outlet 8. More specifically, the regulator 56 preferably includes a first valve 64A configured to control flow through the inlet fluid line 58, a second valve 64B configured to flow through outlet fluid line 60, and a controller 63 configured to operate the two valves 64A, 64B so as to provide a desired ratio of the inlet and outlet pressures $P_I$, $P_O$. Alternatively (or additionally), the two valves 64A, 64B may be manually operable, such as by means of a handle, etc.

With the above-described structure, the valve assembly 10 of the present invention functions generally as follows. As the preferred piston 4 displaces within the compressor casing 3 to pressurize or compress fluid, e.g., process gas, located within the compressor chamber $C_C$, the pressure within the chamber section $c_{V1}$, $c_{V2}$ (discussed below) to which the unloader chamber is fluidly connectable (i.e., through the valve 10) begins to increase. At some point in the piston displacement cycle, the pressure $P_C$ in the compressor chamber section $C_C$ increases to the point that the pressure $P_S$ on the valve sealing end surface 28 of each closing element 12 is greater than the pressure on the pressure $P_C$ on the associated control end surface 30. As such, the one or more valve closing elements 12 are displaced toward an open position $p_O$, thereby fluidly coupling the compressor chamber section $c_{V1}$ or $c_{V2}$ with the unloader chamber $C_U$. Process fluid flows into the unloader chamber $C_U$ through the valve passage(s) 16 until the pressure $P_S$ at the closing element sealing surface 28 becomes lesser than the control chamber pressure $P_C$ acting on the control end surface 30, at which point the net pressure acting on each closing element main body 24 causes the main body 24 to displace to the closed position $p_C$. At this point, the unloader chamber $C_U$ is again isolated or sealed from the compressor chamber $C_C$.

By having the improved closing element(s) 12 of the present invention, leakage of control fluid about each closing element 12 is at least reduced, and preferably substantially prevented. As such, the closing elements 12 are operable with a lesser required control pressure $P_C$ acting on the main body 24, as fluid leakage would require a greater control gas pressure $P_C$ to accommodate for the fluid loss due to leakage. As such, the closing elements 12 and the required tubing or other components to establish the control fluid line 50 may be used for a greater range of operating conditions and with a variety of different sized compressors 1. Further, by substantially isolating the control fluid from the process gas, a fluid (e.g., nitrogen) different than the process fluid (e.g., natural gas) may be used for the control fluid, such that a completely separate control fluid assembly 54 with a source of control gas (not shown) may be constructed and used to control the unloader valve assembly 10.

Having discussed the basic elements and functions above, these and other features of the valve assembly 10 and the valve closing element 12 of the present invention are described in greater detail below.

Figure 14:
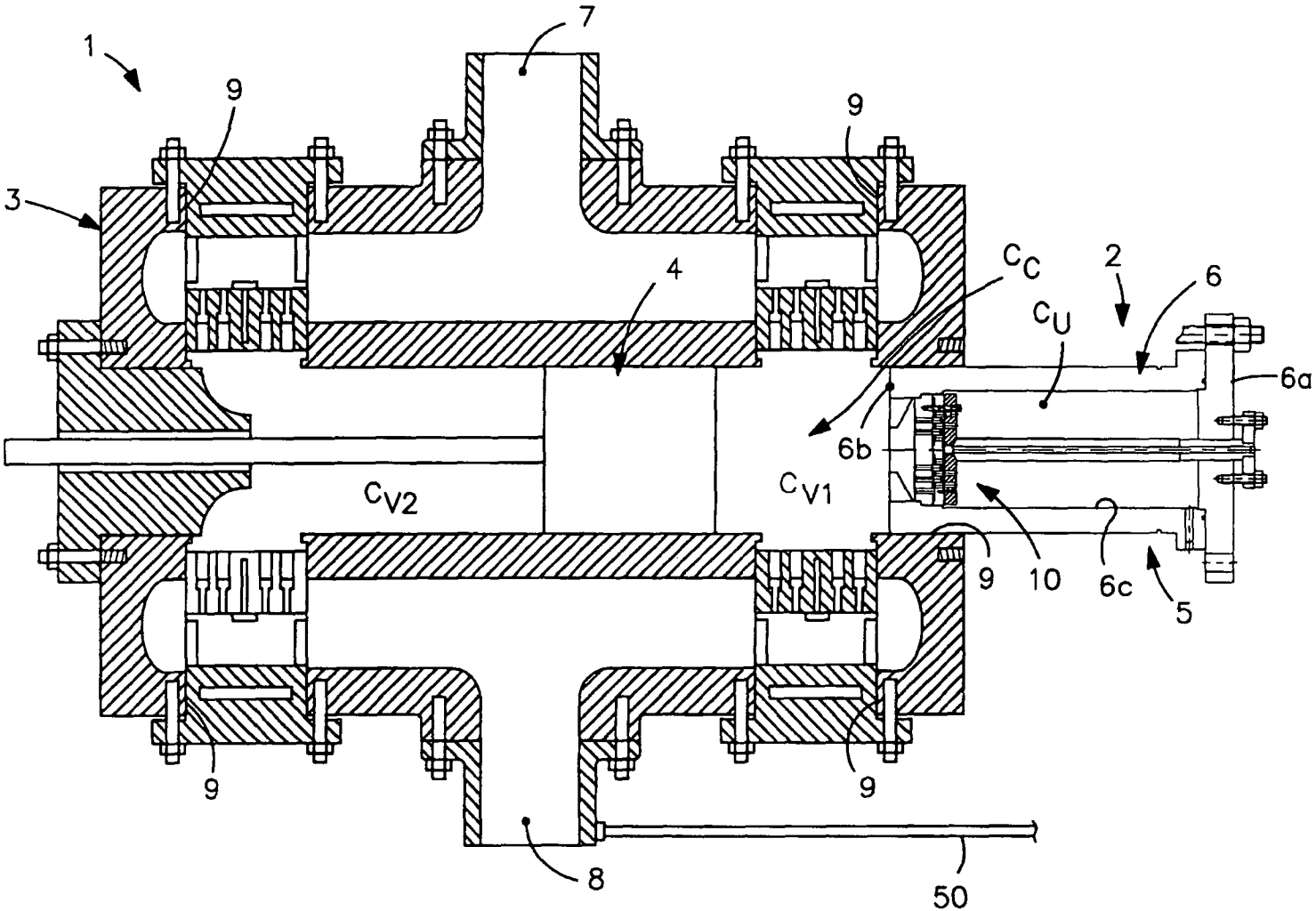
FIG. 14 is a broken-away, axial cross-sectional view of an unloader, shown mounted to a head of a compressor.
Figure 15:
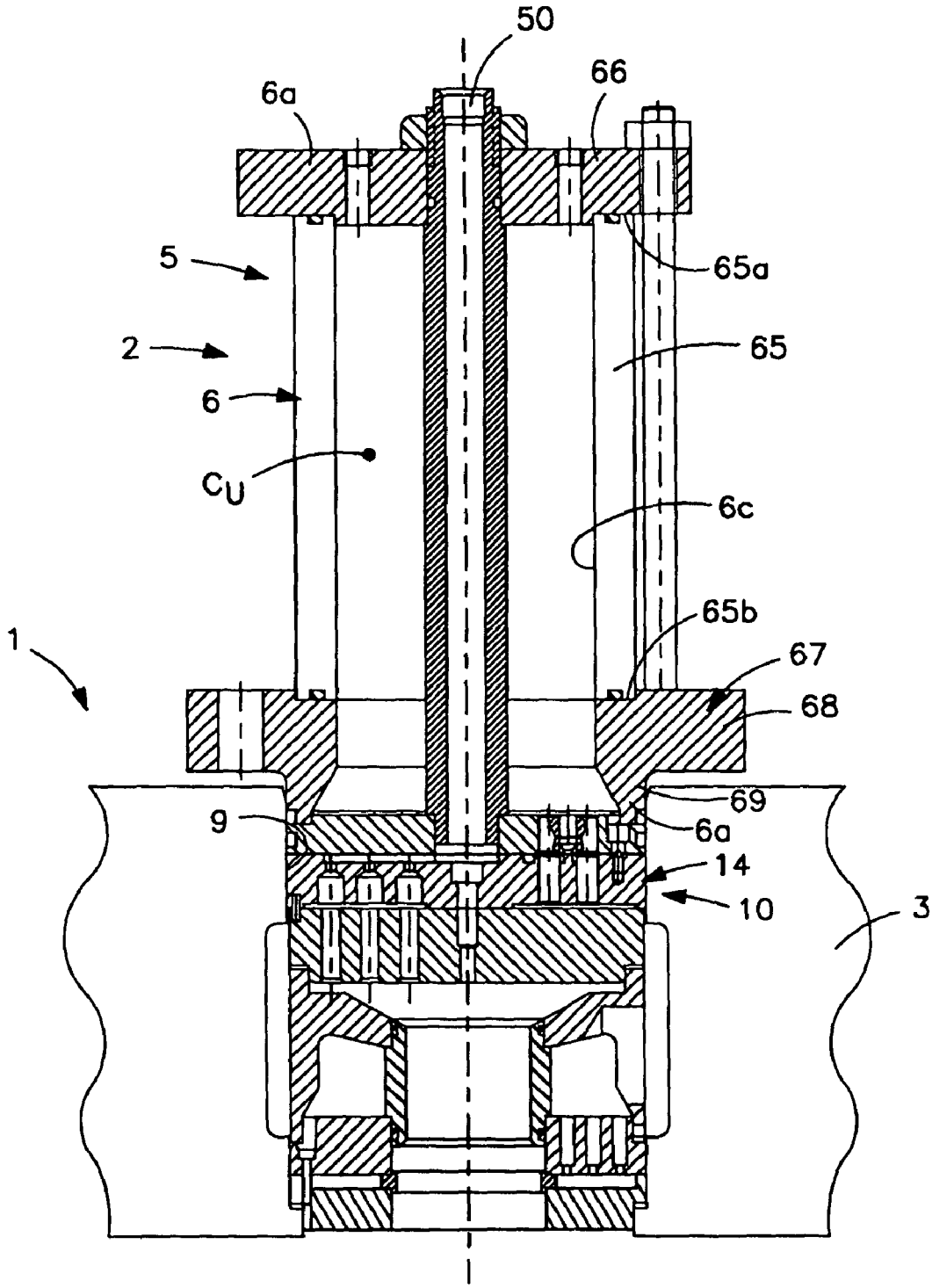
FIG. 15 is a broken-away, axial cross-sectional view of another unloader, shown mounted to an inlet of the compressor.
Figure 17:
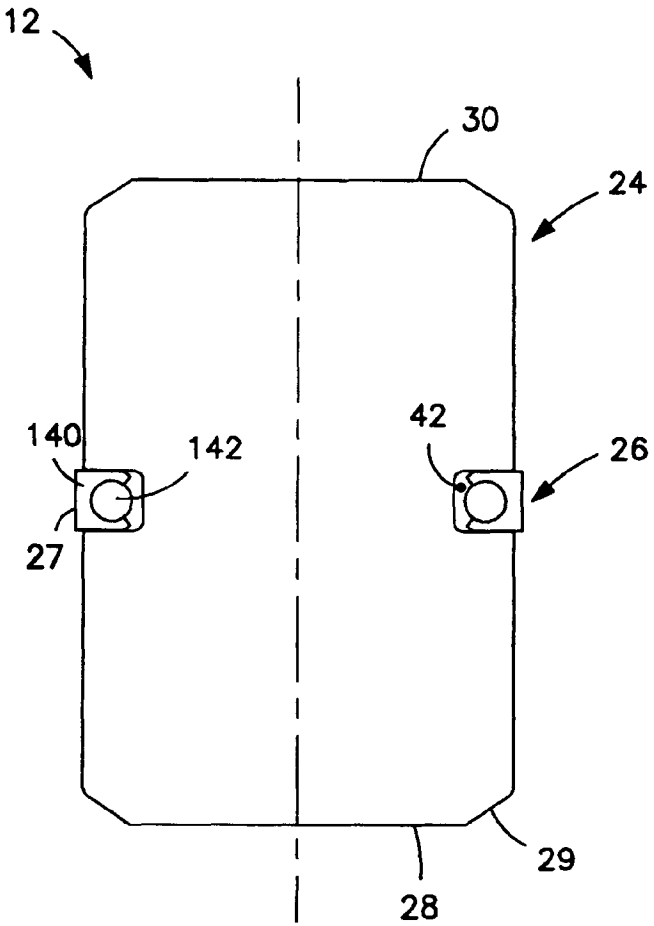
FIG. 17 is an axial cross-sectional view of another alternative valve closing element having a two-piece sealing member.

Referring to FIGS. 3, 14 and 15, the valve assembly 10 is preferably used with a compressor 1 having a casing 3 with at least one and preferably a plurality of unloader holes 9 extending into, or at least fluidly coupled with, the compression chamber $C_C$. Each unloader hole 9 is preferably configured to receive at least a portion of a separate unloader valve base 14, as described above and in further detail below, such that the valve passage(s) 14 control flow between the compression chamber $C_C$ and the associated unloader chamber $C_U$. As such, the compressor 1 may be provided with only a single unloader 2 or two or more unloaders 2, as necessary to achieve the desired operating characteristics for a particular compressor 1.

Further, each unloader hole 9 is located such that a variable volume chamber section $c_{V1}$ or $c_{V2}$ of the compressor chamber $C_C$, i.e., each located on an opposing side of the piston 4, is fluidly coupled with each unloader 2 through the one or more passages 16 of the unloader valve assembly 10. The preferred compressor 1 is configured or constructed such that movement of the compression member or piston 4 varies the volume and pressure within each compressor chamber section $c_{V1}$ or $c_{V2}$. The control fluid line 50 is configured to fluidly connect the one or more stem bore control chambers 22 with the compressor inlet 7 and/or outlet 8 such that pressure variation within the compressor chamber variable section $c_{V1}$, $c_{V2}$ adjusts or varies the pressure $P_S$ on both the closing element sealing end surface(s) 28 and the pressure $P_C$ on the control end surface(s) 30. Such pressure variations displace each closing element 12 between the closed and open positions $p_C$, $p_O$, as discussed above.

Referring now to FIGS. 1, 14 and 15, the housing 5 of each unloader 2 preferably includes a generally tubular body 6 adapted to receive or connect with one valve base 14 and either directly mountable to the compressor 1, or/and connected therewith by means of the valve base 14. The unloader body 6 has an enclosed end 6*a*, an opposing open end 6*b*, and a central bore 6*c* extending between the two ends 6*a*, 6*b* and providing the unloader chamber $C_U$. Most preferably, the unloader body 6 includes a generally circular tubular sidewall 65 having opposing ends 65*a*, 65*b*, a generally circular end plate 66 attached to the sidewall outer end 65*a* and a generally annular mounting plate 67 attached to the sidewall inner end 65*b*. The mounting plate 67 provides a mounting flange 68 connectable with the compressor casing 3 and includes a circular engagement wall 69 disposeable within a casing unloader hole 9.

Figure 2:
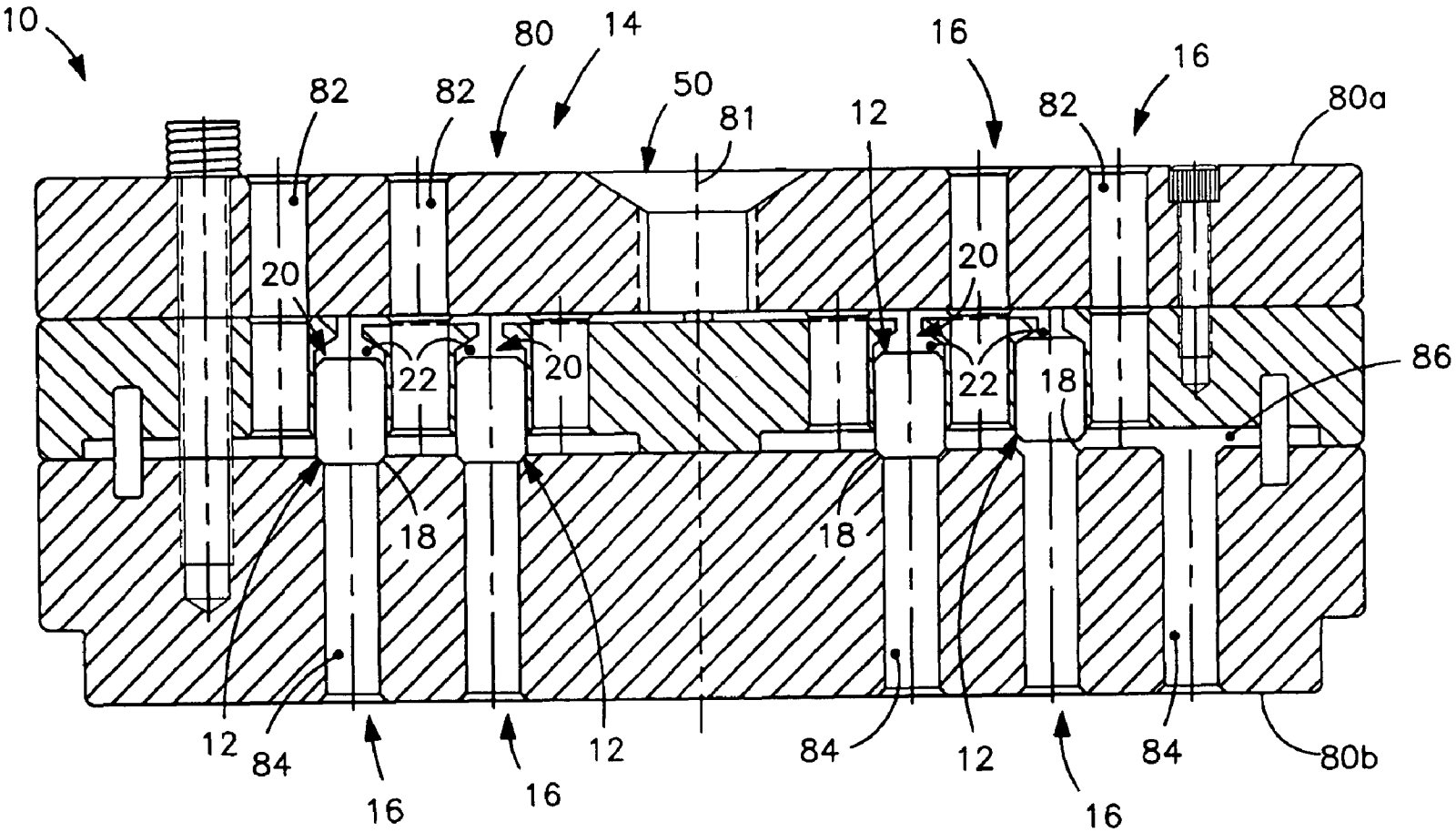
FIG. 2 is an enlarged axial cross-sectional view of the valve assembly of the present invention.
Figure 13:
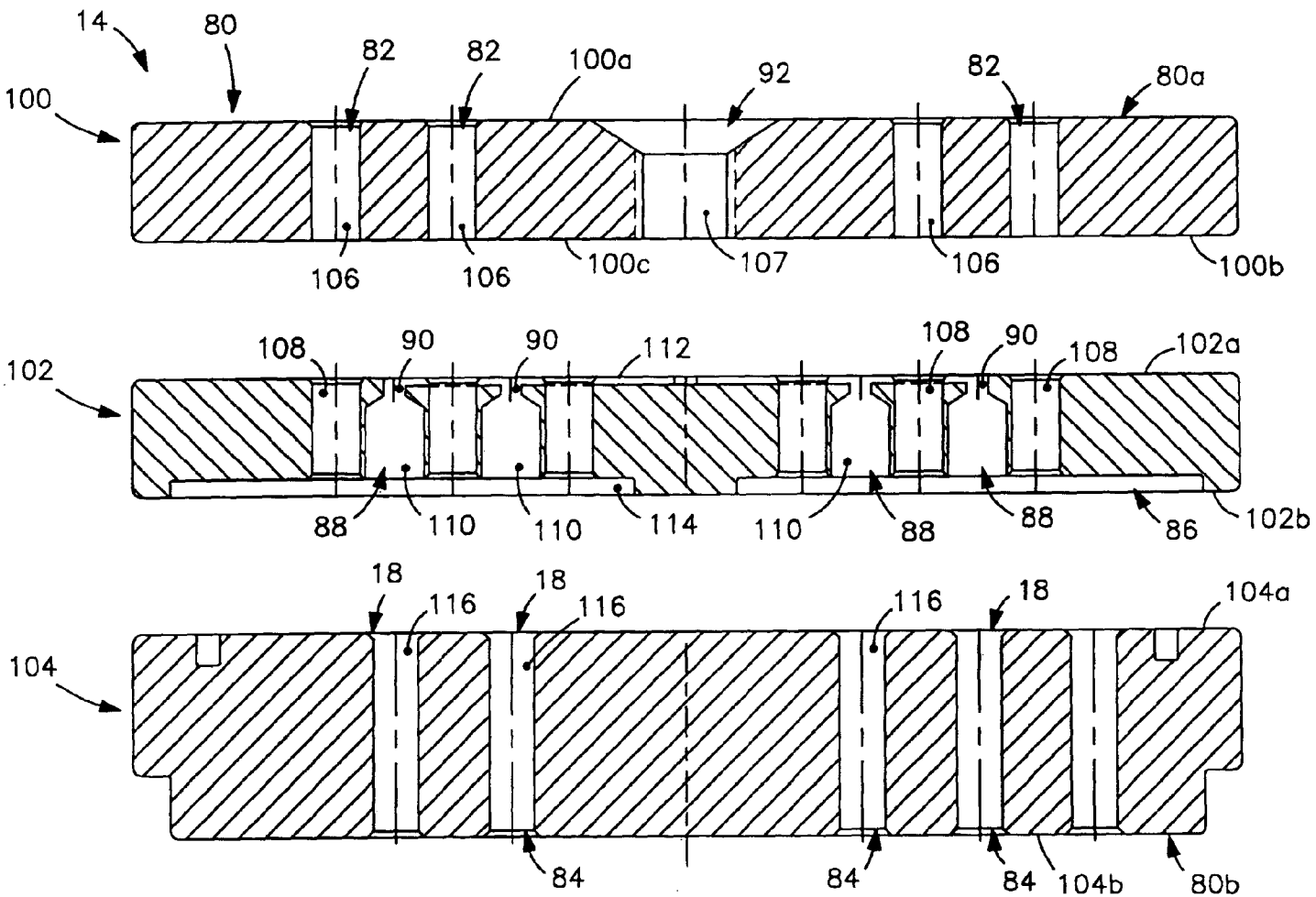
FIG. 13 is an enlarged view of a preferred valve base, shown with the preferred base plates spaced apart.

Referring now to FIGS. 2 and 13, 15, as discussed above, the base 14 of each valve 10 is sized to fit at least partially within one casing hole 9 so as to generally restrict flow through the hole 9, so that the compression and unloader chambers $C_C$, $C_U$ are fluidly connected through the one or more valve passages 16. Each valve base 14 is disposed against, or within, the unloader body open end 6*b*, most preferably against the unloader engagement wall 69, so as to generally enclose the unloader chamber $C_U$. Preferably, the valve base 14 includes a generally cylindrical body 80 having first and second ends 80*a*, 80*b* and a central axis 81 extending between the two ends 80*a*, 80*b*. A plurality of first valve passage holes 82 extend into the body 80 from the first end 80*a* and partially therethrough generally toward the body second end 80*b* and a plurality of second valve passage holes 84 extending into the body from the second end 80*b* and partially therethrough generally axially toward the body first end 80*a*. At least one connective passage 86 extends generally radially within the body 80 and fluidly connects at least one of the first valve holes 82 with at least one second valve hole 84 so as to form at least one valve passage 16.

Further, the cylindrical valve base body 80 also includes a plurality of bore holes 88 axially aligned with a separate one of the second valve passage holes 84 and having a first end 88*a* fluidly connected with at least one connective passage 86 and an opposing second end 88*a*. Each body bore hole 88 provides a separate one of the stem bores 20 and as such, are sized to receive a separate one of the closing elements 12 such that a control chamber section 22 is defined between the closing element main body 24 and the body bore hole second end 88*b*. Furthermore, a plurality of control ports 90 extending generally into the control chamber section 22 of a separate one of the stem bore holes 88 and a central control fluid hole 92 extends into the valve body 80 from the first end 80*a* and partially therethrough generally toward the body second end 80*b*, the control hole 92 being connectable with a source of control pressure, as discussed above. At least one control connective passage 94 extends generally radially within the valve body 80 and fluidly connects the control hole 92 with one or more of the control ports 90, thereby fluidly connecting the control pressure source, i.e., the inlet 7 and/or outlet 8 or separate source (none shown), with each of the stem bore control chamber sections 20.

Most preferably, the above-discussed cylindrical valve base body 80 is formed of an assembly of three connected-together, generally circular plates 100, 102, 104. Specifically, a first or outer plate 100 has an outer axial end 100*a* providing the valve body first end 80*a*, an opposing inner axial end 100*b*, a plurality of through holes 106 each providing an outer section of a separate one of the first valve passage holes 82, and a central through bore providing the control fluid hole 92. A second or middle plate 102 has first and second opposing axial ends 102*a*, 102*b*, the middle plate first end 102*a* being disposed against the outer plate inner end 100*a*, a plurality of through holes 108 each providing an inner section of a separate one of the first valve passage holes 82 and a plurality of counterbore holes 110 each providing a separate one of the stem bore holes 20 and the connected control ports 90. A plurality of radially-extending recesses 112 each extend into the second plate 102 from the plate first end 102*a* and are each connected with at least one control port 90 and provide one control connective passage 94. Further, a generally annular recess 114 extends into the middle plate 102 from the plate second end 102*b* and provides a common connective passage 86 for all the valve passages 14. Furthermore, a third or inner plate 104 has an outer axial end 104*b* providing the valve body second end 80*b*, an opposing inner axial end 104*a* disposed against the middle plate second end 102*b* and a plurality of through holes 116 each providing a separate one of the second valve passage holes 84.

Referring to FIGS. 6 and 7, each closing element main body 24 is preferably formed as a generally circular cylindrical body 120 having a central circumferential cut-out 122 providing the annular recess 42, as described above, and defining upper and lower, generally circular head portions 124A, 124B. Each generally circular head portion 124A, 124B provides a separate one of the radially-larger outer surface sections 38A, 38B described above. Preferably, the cylindrical body 120 is solid and formed as a one piece construction, but may be formed of multiple connected pieces and/or may have a generally hollow interior. Further, the cylindrical main body 24 may have any other appropriate shape, such as a generally ovular, generally hexagonal, and/or may have any appropriate structure for retaining the sealing member 26, such that the closing element 12 is capable of generally functioning as descried herein.

Referring now to FIGS. 6, 7 and 16-18, each valve closing element 12 preferably includes a single sealing member 26 including a generally circular tubular sleeve 130 having inner and outer circumferential surfaces 132, 134. The tubular sleeve 130 is engage with the main body 24, specifically with the annular recess 42, so as to form an inner annular clearance space $S_{CI}$, as described above. However, as discussed above, each valve closing element 12 may alternatively include two or more axially spaced sealing members 26, each formed for example, as a tubular sleeve 130 (as shown in FIG. 16), an annular ring, etc. In another alternative construction shown in FIGS. 17 and 18, each sealing member 26 may be formed so as to include an outer sealing ring 140 disposed at least partially within the main body annular recess 42, the outer ring having an outer circumferential surface 141 disposeable against the stem bore 20, and an inner support ring 142. The support ring 142 is disposed within the recess 42 and is configured to generally prevent deflection of the outer sealing ring 140 generally radially toward the main body axis 24*a*. Furthermore, the sealing member 26 (or/and the main body 24) may alternatively be formed with one or more flexible centering members (e.g., cantilever arms, etc.) extending between the sealing member inner surface 34 and the main body outer surface 32 and permitting relative radial displacement of the main body 24 (structure not shown). Additionally, the main closing element main body 24 is preferably formed of a metallic material (e.g., alloy steel) and the at least one sealing member 26 is preferably formed of a polymeric material, most preferably polytetrafluroethylene ("PTFE"), although either component 24 or 26 may be formed of any appropriate material as desired.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as generally defined in the appended claims.

I claim:

1. A closing element for a valve assembly of a compressor unloader, the compressor including a casing and a compression chamber defined within the casing, the unloader including a housing defining a fixed volume chamber, and the valve assembly having a base disposed generally between the compression and unloader chambers, a passage extending through the base and fluidly connecting the two chambers, a seat defined about a section of the passage, and a stem bore defined within the base and having a control chamber section and a central axis, the valve closing element comprising:

a generally cylindrical main body moveably disposed at least partially within the stem bore so as to be displaceable generally along the bore axis, the main body having a sealing end surface, the sealing surface being disposeable against the valve seating surface so as to substantially obstruct the valve passage, and an opposing control end surface disposed within the bore control chamber section; and a sealing member disposed generally about the main body and located generally between the sealing and control surfaces, the sealing member being configured to substantially prevent fluid flow between the control chamber section and the valve passage through the stem bore, at least one of the cylindrical main body and the sealing member being configured such that the main body is generally radially moveable with respect to the bore axis to at least generally align the main body sealing surface with the valve seat.

2. The valve closing element as recited in claim 1 wherein the valve seat is generally centered about an axis, the cylindrical main body sealing surface is generally centered about an axis through the main body, and the at least one of the main body and the sealing member is configured to enable sufficient radial displacement of the main body with respect to the bore axis such that when the sealing surface axis is spaced radially apart from the valve seat axis, the sealing surface axis becomes generally coaxially aligned with the valve seat axis when the body sealing surface contacts the valve seat.

3. The valve closing element as recited in claim 1 wherein the cylindrical main body is displaceable in a first direction along the stem bore axis generally toward the valve seat, the at least one of the main body and the sealing member being configured such that when the sealing surface is misaligned with the valve seat, contact between a radially-outermost portion of the sealing surface and the valve seat while the main body displaces in the first direction pushes the main body to displace radially until the sealing surface is generally centered against the valve seat.

4. The valve closing element as recited in claim 1 wherein:

the valve seat includes a generally frustaconical inner surface extending circumferentially about a section of the valve passage;

the main body sealing surface has a generally frustaconical outer surface section sized to be disposeable against the seat conical surface so as to substantially seal the valve passage; and the at least one of the main body and the sealing member is configured to enable radial displacement of the main body with respect to stem bore axis to generally align the main body outer frustaconical surface section with respect to the valve seat inner frustoconical surface as the cylindrical main body displaces generally toward the valve seat.

5. The valve closing element as recited in claim 1 wherein:

the cylindrical main body has a longitudinal axis and an outer circumferential surface extending about the axis, the outer surface having an outside diameter; and the sealing member has an inner circumferential surface extending generally about the main body outer surface and having an inside diameter, the sealing member surface inside diameter being greater than the main body surface outside diameter such that a generally annular, inner clearance space is defined between the sealing member and the main body so that the main body is moveable radially with respect to the sealing member.

6. The valve closing element as recited in claim 5 wherein:

the valve base has an inner circumferential surface extending about the bore axis and defining the stem bore;

the outer surface of the cylindrical main body is a first outer surface and the main body further includes a pair of second outer circumferential surfaces each extending about the body axis and having an outside diameter, the outside diameter of each second outer surface being greater than the first surface outside diameter and greater than the sealing member inner surface inside diameter; and the sealing member further has an outer circumferential sealing surface, the outer sealing surface being disposeable against the stem bore inner circumferential surface so as to substantially prevent gas flow between the main body sealing and control ends and having an outside diameter, the sealing member outside diameter being greater than the outside diameter of the main body second outer surfaces such that a generally annular outer clearance space is defined between the bore inner surface and each of the main body second outer surfaces so that the main body is radially moveable with respect to the stem bore.

7. The valve closing element as recited in claim 6 wherein:

the cylindrical main body further has two spaced apart, generally facing shoulder surfaces each extending generally radially between a separate one of the second outer surfaces and the first outer surface; and the sealing member has opposing radial ends each disposed generally against a separate one of the main body shoulder surfaces so as to generally prevent fluid flow between each outer clearance space and the inner clearance space.

8. The valve closing element as recited in claim 1 wherein:

the cylindrical main body has a central longitudinal axis extending between the sealing and control surfaces, an outer circumferential surface extending about the body axis, and a generally annular recess extending radially inwardly from the outer surface; and the sealing member includes a generally annular body partially disposed within the main body recess so as the couple the sealing member body with the main body, the body having an inner circumferential surface sized to define an inner clearance space being between the sealing member body and the main body recess for permitting radial movement of the main body with respect to the sealing member, and an outer circumferential surface disposeable against the stem bore and spaced radially outwardly with respect to the main body outer surface such that an outer clearance space is defined generally between the main body outer surface and the stem bore, the outer clearance space permitting radial movement of the main body with respect to the stem bore.

9. The valve closing element as recited in claim 8 wherein:

the cylindrical main body further has two axially spaced-apart, generally facing shoulder surfaces at least partially defining the recess; and the sealing member body further includes opposing axial ends surfaces, each end surface being disposed against a separate one of the body radial surfaces so as to prevent fluid flow between the outer clearance space and the inner clearance space.

10. The valve closing element as recited in claim 1 wherein:

the cylindrical main body has a central longitudinal axis extending between the sealing and control surfaces and a generally annular recess extending circumferentially about the body axis; and the sealing member includes an outer sealing ring disposed at least partially within the main body annular recess, the outer ring having an outer circumferential surface disposeable against the stem bore, and an inner support ring disposed within the recess and configured to generally prevent deflection of the outer sealing ring generally radially toward the main body axis.

11. The valve closing element as recited in claim 1 wherein the cylindrical main body is displaceable within the stem bore generally along the stem bore axis when pressure on one of the sealing end surface and the control end surface is sufficiently greater than pressure on the other one of the sealing end surface and the control end surface.

12. The valve closing element as recited in claim 11 wherein:

the cylindrical main body displaces in a first direction along the stem axis and toward the valve seat when the main body is spaced from the valve seat and pressure on the control end surface is sufficiently greater than pressure on the sealing end surface;

the cylindrical main body displaces in a second direction along the stem axis and generally away from the valve seat when the main body is at least generally proximal to the valve seat and pressure on the sealing end surface is sufficiently greater than pressure on the control end surface.

13. The valve closing element as recited in claim 1 wherein:

the compressor further includes an inlet and an outlet each fluidly coupled with the compression chamber; and the valve assembly further includes a control fluid line fluidly connected with the stem bore control chamber section and at least one of the compressor inlet and the compressor outlet such that the closing element main body is one of displaced generally toward and disposed against the valve seat when pressure at the at least one of the inlet and the outlet is greater than pressure in the compression chamber and the main body member is one of displaced generally away from and spaced from the valve seat when pressure at the least one of the inlet and the outlet is lesser than pressure in the compression chamber.

14. The valve closing element as recited in claim 1 wherein:

the compressor further includes an inlet and an outlet each fluidly coupled with the compression chamber and the valve assembly further includes a control fluid line fluidly connected with the stem bore control chamber section and at least one of the compressor inlet and the compressor outlet;

the cylindrical main body at least one of displaces generally toward and is disposed against the valve seat when pressure at the at least one fluidly connected one of the inlet and the outlet is greater than pressure in the compression chamber; and the main body one of displaces generally away from and is spaced from the valve seat when pressure at the least one of the inlet and the outlet is lesser than pressure in the compression chamber.

15. The valve closing element as recited in claim 14 wherein pressure on the main body sealing end surface is generally equal to pressure in the compression chamber and pressure on the main body control surface is one of generally equal to pressure at the at least one connected compressor inlet and compressor outlet.

16. The valve closing element as recited in claim 14 wherein the valve assembly further includes a control fluid assembly having a pressure regulator, an inlet fluid line fluidly connected with the compressor inlet and the regulator, and an outlet fluid line fluidly connected with the compressor outlet and the regulator, the control fluid line being fluidly connected with the regulator, the regulator being configured to adjust pressure in the control line between pressure at the compressor inlet and at the compressor outlet.

17. The valve closing element as recited in claim 1 wherein the closing element main body is displaceable between a first position at which the body sealing surface is disposed generally against the valve seat and a second position at which the body sealing surface is spaced from the valve seat such that the valve passage fluidly connects the compression chamber with the unloader chamber.

18. The valve closing element as recited in claim 1 wherein:

the cylindrical main body is displaceable with respect to the stem bore between a closed position at which the main body sealing surface is disposed generally against the valve seat and at least one open position at which the main body sealing surface is spaced from the valve seat; and the cylindrical main body is biased generally toward the closed position when pressure on the control surface is greater than pressure on the sealing surface and the main is alternatively biased generally toward the at least one open position when pressure on the sealing surface is greater than pressure on the control surface.

19. The valve closing element as recited in claim 18 wherein the sealing member has an outer circumferential sealing surface engageable with the stem bore to prevent fluid flow between the valve passage and the bore control chamber section, the sealing member being configured such that at least a portion of the outer circumferential sealing surface remains engaged with the stem bore as the main body displaces between the closed and open positions.

20. The valve sealing member as recited in claim 1 wherein:

the valve base has an inner circumferential surface extending about the bore axis and at least partially defining the stem bore;

the closing element main body is displaceable along the bore axis from a closed position at which the sealing surface is disposed generally against the valve seat and an open position at which the sealing surface is spaced from the valve seat such that the compression chamber is fluidly coupled with the unloader chamber; and at least a portion of the at least one sealing member remains in contact with the stem bore inner surface as the main body displaces between the closed and open positions.

21. The valve closing element as recited in claim 1 wherein the sealing member includes a generally tubular sleeve having inner and outer circumferential surfaces, the inner surface being disposeable about a portion of the cylindrical main body and the outer surface being disposeable against at least a portion of the stem bore so as to form a seal.

22. The valve closing element as recited in claim 1 wherein the sealing member includes at least two axially spaced, generally annular members each having inner and outer circumferential surfaces, the inner surface of each annular member being disposeable about a portion of the cylindrical main body and the outer surface of each annular member being disposeable against at least a portion of the stem bore so as to form a seal.

23. The valve closing element as recited in claim 1 wherein the main body is formed of metallic material and the at least one sealing member is formed of an elastomeric material.

24. A valve assembly for a compressor unloader, the compressor including a casing and a compression chamber defined within the casing, the unloader including a housing defining a fixed volume chamber, the valve assembly comprising:

a base disposed generally between the compression and unloader chambers, the base having a plurality of passages extending through the base and fluidly connecting the compression and unloader chambers, a plurality of valve seats each defined about a section of a separate one the passages, and plurality of stem bores each defined within the base proximal to a separate one of the passages and each having a control chamber section and a central axis; and a plurality of valve closing elements disposed within each stem bore, each closing element including:

a generally cylindrical main body movably disposed at least partially within the stem bore so as to be displaceable generally along the bore axis, the main body having a sealing end surface, the sealing surface being disposeable against the valve seating surface so as to substantially obstruct the valve passage, and an opposing control end surface disposed within the bore control chamber section; and a sealing member disposed generally about the main body and located generally between the sealing and control surfaces, the sealing member being configured to substantially prevent fluid flow between the control chamber section and the valve passage through the stem bore, at least one of the cylindrical main body and the sealing member being configured such that the main body is generally radially moveable with respect to the bore axis to at least generally align the main body sealing surface with the valve seat.

25. The valve assembly as recited in claim 24 wherein:

the compressor casing has a hole extending into the compression chamber;

the valve base is sized to fit at least partially within the casing hole so as to generally restrict flow through the casing hole such that the compression and unloader chambers are fluidly connected through the valve passages.

26. The valve assembly as recited in claim 24 wherein the base includes a body having:

first and second ends and a central axis extending between the two ends;

a plurality of first valve passage holes extending into the body from the first end and generally toward the body second end;

a plurality of second valve passage holes extending into the body from the second end and generally toward the body first end;

at least one connective passage extending generally radially within the body and fluidly connecting at least one of the first valve holes with at least one second valve hole so as to form at least one valve passage.

27. The valve assembly as recited in claim 26 wherein the valve body further has:

a plurality of bore holes axially aligned with a separate one of the second valve passage holes and having a first end fluidly connected with at least one connective passage and an opposing second end, each body bore hole providing a separate one of the stem bores, being sized to receive a separate one of the closing elements such that a control chamber section is defined between the closing element main body and the body bore hole second end;

a plurality of control ports extending generally into the control chamber section of a separate one of the stem bore holes;

a control hole extending into the body from the first end and generally toward the body second end and connectable with a source of control pressure; and a control connective passage extending generally radially within the body and fluidly connecting the control hole with at least one of the control ports so as to fluidly connect the control pressure source with each of the stem bore control chamber sections.

28. The valve assembly as recited in claim 27 wherein the base body includes:

a first plate having an outer axial end providing the body first end, an opposing inner axial end, a plurality of through holes each providing an outer section of a separate one of the first valve passage holes, and a central through bore providing the control hole;

a second plate having first and second opposing axial ends, the second plate first end being disposed against the first plate inner end, a plurality of through holes each providing an inner section of a separate one of the first valve passage holes, a plurality of counterbore holes each providing a separate one of the stem bore holes and the connected control ports, a plurality of radially extending recesses each extending into the second plate from the plate first end, connected with at least one control port and providing one control connective passage, and a generally annular recess extending into the second plate from the plate second end and providing the at least valve connective passage; and a third plate having an outer axial end providing the body second end, an opposing inner axial end disposed against the second plate second end, a plurality of through holes each providing a separate one of the second valve passage holes.

29. A compressor assembly comprising:

a compressor including a casing, a compression chamber defined within the casing, and a compression member movably disposed within the chamber;

an unloader mounted to the casing and including a housing defining a fixed volume chamber fluidly connectable with the compression chamber; and a valve assembly configured to control flow between the compression chamber and the unloader chamber, the valve assembly including:

a base disposed generally between the compression and unloader chambers, the base including a passage extending through the base and fluidly connecting the two chambers, a seat defined about a section of the passage, and a stem bore defined within the base and having a control chamber section and a central axis;

a valve closing element including a generally cylindrical main body moveably disposed at least partially within the stem bore so as to be displaceable generally along the bore axis and a sealing member disposed generally about the main body, the main body having a sealing end surface disposeable against the valve seating surface so as to substantially obstruct the valve passage and an opposing control end surface disposed within the bore control chamber section, the sealing member being configured to substantially prevent fluid flow between the control chamber section and the fluid passage, at least one of the cylindrical main body and the sealing member being configured such that the main body is generally radially moveable with respect to the bore axis to at least generally align the main body sealing surface with the valve seat.

30. The compressor assembly as recited in claim 29 wherein:

the compressor further includes an inlet and an outlet each fluidly coupled with the compression chamber;

the compressor casing has a hole extending into the compression chamber;

the valve base is sized to fit at least partially within the casing hole so as to generally restrict flow through the casing hole such that the compression and unloader chambers are fluidly connected through the valve passage.

31. The compressor assembly as recited in claim 30 wherein:

the compressor casing hole is located such that a variable volume section of the compressor chamber is fluidly coupled with the unloader through the valve passage;

the compressor is configured such that movement of the compression member varies the volume and pressure within the compressor chamber section;

the valve assembly further includes a control fluid line configured to fluidly connect the stem bore control chamber with at least one of the compressor inlet and outlet such that pressure variation within the compressor chamber variable section adjusts pressure on the closing element sealing end surface and pressure on the control end surface so as to displace the closing element between a closed position and at least one open position.

32. The compressor assembly as recited in claim 31 wherein the unloader chamber is sealed from the compressor chamber variable section when the closing element is located at the closed position and the unloader chamber is fluidly coupled with the compressor chamber variable section when the closing element is located at the at least one position.

33. The compressor assembly as recited in claim 29 wherein:

the unloader includes a generally tubular body with an enclosed end, an opposing open end, and a central bore extending between the two ends and providing the unloader chamber; and the valve base includes a generally cylindrical body with opposing inner and outer ends and at least one generally axially extending passage extending between the inner and outer ends and providing the valve passage, the valve body inner end being disposed against the unloader tubular body open end so as to generally enclose the unloader chamber.

34. A closing element for a valve assembly of a compressor unloader, the compressor including a casing and a compression chamber defined within the casing, the unloader including a housing defining a fixed volume chamber, and the valve assembly having a base disposed generally between the compression and unloader chambers, a passage extending through the base and fluidly connecting the two chambers, a seat defined about a section of the passage, and a stem bore defined within the base and having an inner surface defining a control chamber section and a central axis, the valve closing element comprising:

a generally cylindrical main body moveably disposed at least partially within the stem bore so as to be displaceable generally along the bore axis, the main body having opposing first and second ends, a sealing surface located at least generally proximal to the body first end and being disposeable generally against the valve seating surface so as to substantially obstruct the valve passage, a control end surface at the body second end and disposed within the bore control chamber section, an outer circumferential surface extending generally between the two end surfaces, and a generally annular recess extending radially inwardly from the outer surface; and at least one generally annular sealing member disposed at least partially within the main body recess so as to movably couple the sealing member with the main body, the sealing member having an outer circumferential surface, the outer surface being disposeable against the bore inner surface and spaced outwardly from the main body outer surface so as to define at least one generally annular outer clearance space, and an opposing inner circumferential surface disposed within the main body recess so as to define a generally annular inner clearance space, the inner and outer clearance spaces enabling radial displacement of the main body with respect to the bore axis and with respect to the sealing member.

* * * * *